US005101138A

United States Patent [19]

Losonczi et al.

[11] Patent Number: 5,101,138

[45] Date of Patent: Mar. 31, 1992

[54] HALOGEN-FILLED INCANDESCENT LAMP AND INSIDE CURRENT CONDUCTOR THEREFOR

[75] Inventors: Zoltán Losonczi; Emil Czakó; György Szabó; György Orsányi, all of Budapest, Hungary

[73] Assignee: Tungsram Részvénytársaság, Budapest, Hungary

[21] Appl. No.: 628,142

[22] Filed: Dec. 17, 1990

[30] Foreign Application Priority Data

Dec. 21, 1989 [HU] Hungary ..... 6709/89

[51] Int. Cl.[5] ..... H01K 1/50; H01J 1/88

[52] U.S. Cl. ..... 313/579; 313/273; 313/279; 313/569; 313/578

[58] Field of Search ..... 313/578, 579, 573, 569, 313/574, 271, 273, 279

[56] References Cited

U.S. PATENT DOCUMENTS 3,510,719 5/1970 Iacianci et al. ..... 313/279

FOREIGN PATENT DOCUMENTS 3124218 3/1982 Fed. Rep. of Germany .

1254616 11/1971 United Kingdom .

*Primary Examiner*—Donald J. Yusko

*Assistant Examiner*—Diab Hamadi

*Attorney, Agent, or Firm*—Spencer & Frank

[57] ABSTRACT

A halogen-filled incandescent lamp includes a curved tube enclosure made of a translucent material and enclosing a gas filling and an incandescent body made of a tungsten wire helix of circular wire cross-section. The incandescent body is arranged within the enclosure. Two inside current conductors connect the incandescent body with an energizing device. Each inside current conductor has first and second spiral members and an elongated part forming together a series assembly. The series assembly is connected via the second spiral member with the incandescent body and via the first spiral member with the energizing device. The series assembly is at least partly made of a wire having a cross-sectional area exceeding that of the tungsten wire forming the incandescent body.

6 Claims, 1 Drawing Sheet $d_1$ = min. 1.4 $d_{sp}$ $D_1$ = min. 2.0 $D_{sp}$
max. 9.6 $D_{sp}$

HALOGEN-FILLED INCANDESCENT LAMP AND INSIDE CURRENT CONDUCTOR THEREFOR

FIELD OF INVENTION

The present invention relates to an inside current conductor applicable in halogen-filled incandescent lamps closed by flattening, particularly lamps having a curved tube enclosure. The invention also relates to a halogen-filled incandescent lamp, comprising a curved tube enclosure made of a translucent material, closed advantageously by flattening and enclosing a gas filling including a halogen element and a noble gas, an incandescent body made by forming a spiral from a tungsten wire of circular cross-section, the incandescent body being arranged within the enclosure, means for energizing the incandescent body sealed preferably by the flattening and two inside current conductors for connecting the incandescent body with the energizing means.

BACKGROUND OF THE INVENTION

According to the general practice of manufacturing the halogen-filled incandescent lamps comprising a translucent enclosure, a helical incandescent body arranged within the enclosure and made of tungsten and means for energizing the incandescent body connectable to an electric supply source are provided. The gas space of the lamp contains a halogen element which is intended to take part in a chemical reaction with the metallic tungsten vaporized from the incandescent body. The vaporized tungsten would be otherwise condensed on different surface parts of the enclosure which are obviously cooler than the incandescent body. The reaction results in a tungsten halide which in given conditions is generally a gaseous compound. The tungsten halide undergoes decomposition on the surface of the incandescent body, thereby transporting tungsten back to the incandescent body and the halogen element is released. The halogen taking part in the cycle described above hinders the process of blackening of the enclosure and ensures an increase of the service life of the tungsten helical body. In order to minimize the effects which adversely affect the cycle, it is very important to manufacture the enclosure in a manner that on its inner surface no area or only a minimized area remains wherein the temperature does not exceed the temperature of condensation of the tungsten halide. The cycle can take place only when conditions are ensured wherein the tungsten halide can easily move within the gas space. While the temperature of the enclosure can be kept without difficulties at such a high value, problems have been encountered in ensuring such high temperatures for the remaining parts of the lamp and especially at the ends of the helical incandescent body. The problem can be solved in principle by two ways, i.e. by passive and active protection.

The passive protection means overdimensioning the parts within the limits allowed by the possibilities, for example either a helical body is arranged as a protecting cover on the so-called interval, i.e. on the coldest parts, or the helical incandescent body is formed in the space surrounded thereby or covered with a thick current conducting wire. Such solutions are described e.g. in United Kingdom Patent 1,254,616 or German Offenlegungsschrift 3,124,218. In the methods of the active protection the temperature is increased by applying appropriate heating means acting on predetermined surfaces.

SUMMARY OF THE INVENTION

The present invention relates to the field of the passive protection and seeks to solve a further object in this field, such object playing an important role in the case of lamps manufactured with curved tube enclosures.

In the halogen-filled lamps manufactured with curved circular, U-shaped or multiangular enclosures, e.g. in infrared lamps, the inside current conductors arranged within the enclosure may not have elongated straight sections (however, this would be required by the shape of the enclosure) because their temperature would be sufficiently low to cause condensation of the tungsten halide. On the contrary, if the current conductors are replaced by respective "incandescent" bodies, a construction would be created which is characterized by disadvantageous performance parameters, and especially by low effectiveness.

Moreover, the process of arranging and fixing the helical incandescent body in the curved tube enclosure of the halogen-filled incandescent lamp would be very difficult and even impossible if the two ends of the active helical incandescent body are connected with an elongated inside current conductor having a relatively high rigidity.

Hence, the object of the invention is to provide a solution whereby the incandescent body applied in a halogen-filled incandescent lamp manufactured with current tube enclosure can be simply arranged in the enclosure and the temperature of the inside current conductors is high enough to exclude condensation of the tungsten halide and low enough to be much lower than the temperature of the helical body during normal operation of the lamp.

For accomplishing the above object, an inside current conductor of novel shape was provided.

Hence, the present invention relates to an inside current conductor applicable in incandescent lamps having a halogen filling. The current conductor according to the invention is formed of a series assembly consisting of at least two spiral members and one elongated part. The series assembly is made of a material having a lower electric resistance than the incandescent body of the lamp. Advantageously, the series assembly consists of two spiral members and the elongated part. The elongated part is connected to the means for energizing and the spiral members have different diameters. The first spiral member is connected with the elongated part and has an outer diameter exceeding the outer diameter of the second spiral member. The outer diameter of the latter is at most equal to the outer diameter of the incandescent body. Generally the series assembly is made of a wire thicker than the wire of the incandescent body.

In a particularly preferred embodiment of the inside current conductor according to the invention the series assembly is made of a tungsten wire of circular cross-section and the diameter of the wire of the series assembly is at least about 1.4 times greater than the diameter of the wire of the incandescent body and the greatest outer diameter of the first spiral member exceeds at least about two times and at most about 9.6 times the outer diameter of the incandescent body.

A further object of the invention is to provide a halogen-filled incandescent lamp, comprising a curved tube enclosure made of a translucent material and enclosing a gas filling including a halogen element and a noble gas, an incandescent body made by a spiral tungsten wire of substantially circular cross-section and being arranged within the enclosure, means for energizing the incandescent body and two inside current conductors for connecting the incandescent body with the energizing means. According to the invention each inside current conductor consists of first and second spiral members and an elongated part forming a series assembly which is connected by means of the second spiral member with the incandescent body arranged within the enclosure and by means of the first spiral member with the energizing means. The series assembly is at least partly made of a wire having a cross-sectional area exceeding the cross-sectional area of the tungsten wire forming the incandescent body, wherein generally tungsten is applied for manufacturing the wires of the series assembly.

The connection between the second spiral member and the incandescent body can be ensured in an especially advantageous way by providing that the second spiral member is at least partly overlapped by the incandescent body.

For practical purposes it is preferred to realize the incandescent lamp of the invention in such a wa that the first spiral member is made with outer diameter exceeding the outer diameter of the second spiral member; the outer diameter of the latter being at most equal to the outer diameter of the incandescent body. Further, advantageously the series assembly is made of a wire of circular cross-section and the diameter of the wire of the series assembly is substantially at least 1.4 times greater than the diameter of the tungsten wire of the incandescent body and the greatest outer diameter of the first spiral member exceed substantially at least two times and substantially at most 9.6 times the outer diameter of the incandescent body.

DETAILED DESCRIPTION OF THE PREFERRED EMBODIMENT

Figure 1:
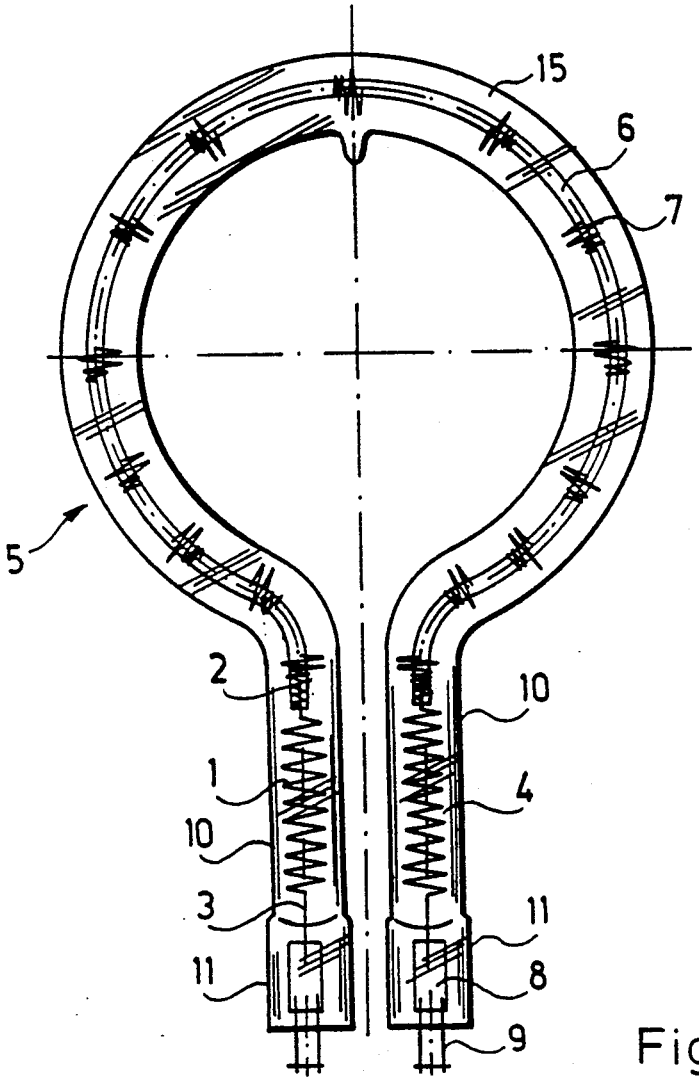
FIG. 1 illustrates schematically a halogen-filled incandescent lamp incorporating the novel inside current conductor of the invention and having a tube enclosure of circular shape flattened on its two ends.

The present invention will be shown in more detail with reference to an incandescent lamp having an enclosure 5 (FIG. 1) made of a translucent material and having substantially circular shape. The enclosure 5 constitutes a unit of a curved tube 15 and two elongated, substantially parallel input tube sections 10 connected with the curved tube 15. In the substantially circular curved tube 15 a helically shaped incandescent body 6 is supported on rings 7. The elongated tube sections 10 receive inside current conductors structured according to the present invention and accommodate, at their free ends in flattened tube sections 11, respective means for energizing the incandescent body 6. Generally, each means for energizing includes a molybdenum foil 8 coupled on one side with the inside current conductor connected with the incandescent body 6 and, on the other side, with outer current lead-ins 9. The inside current conductor is constituted by a series assembly 4 preferably formed of two helical parts of advantageously different diameters and an elongated part 3 connected to the molybdenum foil 8. A series assembly comprising more than two helical parts may also be used. The series assembly 4 includes an elongated part 3, a middle section constituted by a first spiral member 1 and an end section formed by a second spiral member 2, the latter being coupled with the incandescent body 6. The second spiral member 2 is, along its full length, or in part, overlapped by the incandescent body 6. Generally the series assembly 4 is made of tungsten wire, preferably tungsten wire having a circular cross-section similarly to the tungsten wire of the incandescent body.

Before manufacturing the lamp an inner assembly is made which includes in series connection the incandescent body 6 with the supporting rings 7, the two series assemblies 4 as inside current conductors structured according to the invention, the molybdenum foils 8 and the outer current lead-ins 9. This assembly is installed within the enclosure 5 by drawing it from one end of the enclosure 5 to the other end, i.e. from the end of one of the elongated tube sections 10 to the end of the other. This operation of transporting the series assembly through the inner space of the enclosure 5 is only possible when the series assembly 4 as a unit is sufficiently flexible and resilient. The installing operation is facilitated by using the inside current conductor manufactured according to the present invention and equipped with the first spiral member 1 as shown in more detail in FIG. 2. After arranging the series assembly 4 within the enclosure 5, the lamp is manufactured to completion in a manner conventional in this field of the industry.

Figure 2:
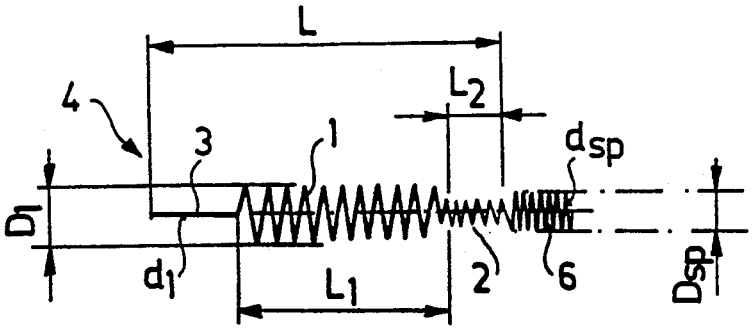
FIG. 2 illustrates a preferred embodiment of the inside current conductor.

Reverting to the inside current conductor structured according to the present invention and illustrated in more detail in FIG. 2, it can be seen that the series assembly 4 includes the elongated part 3 of wire diameter $d_1$ connected at one end to the molybdenum foil 8, generally by welding and connected at the other end to the first spiral member 1 of length $L_1$ and outer diameter $D_1$. The second spiral member 2 connected to the incandescent body 6 is of length $L_2$ and constitutes a transient section having a diameter which is smaller than the diameter $D_{sp}$ of the incandescent body 6 which is made of a wire of diameter $D_{sp}$. The outer diameter $D_1$ of the first spiral member 1 is generally four times greater than the outer diameter of the incandescent body 6, but it can be smaller or bigger than this limit. It is of importance only that its temperature during operation of the lamp should be sufficiently high to exclude condensation of the tungsten halide and sufficiently low to avoid radiation. The elongated part 3 of the series assembly 4 of the inside current conductor, and generally the whole series assembly 4 is manufactured from a wire of diameter $d_1$ exceeding preferably at least 1.4 times the diameter $d_{sp}$ of the wire of the incandescent body 6 in order to reduce its electric resistance in comparison to the resistance of the incandescent body 6. Of course, this reduction can be ensured by wires of noncircular cross sections too, when the electric resistance is determined on the basis of the surface area of the cross sections or by applying wires of different materials, if appropriate.

The upper limit of the wire thickness should be such that it is sufficiently flexible to form a helix therefrom. This is especially important for the second spiral member 2 which has to be made of a wire of high resiliency. The outer diameter of the second spiral member 2 is at most as large as the outer diameter $D_{sp}$ of the incandescent body 6, but generally it is selected to be smaller. The spiral member 2 is generally shorter than the first spiral member 1 and it is electrically connected with the end of the incandescent body 6. It has been found in practice that it is especially advantageous to prepare the first spiral member 1 with outer diameter $D_1$ exceeding at least 2.0 times and at most 9.6 times the outer diameter $D_{sp}$ of the incandescent body 6.

EXAMPLE

A 150 V and 800 W halogen-filled lamp for heat radiation is manufactured.

The lamp has an enclosure 5 made of quartz and having a substantially circular shape of a diameter of about 200 mm. The inner diameter of the tube of the enclosure 5 is substantially 15 mm.

The incandescent body 6 of the lamp is made of a tungsten wire of 0.25 mm diameter by forming a helix of an outer diameter $D_{sp}$ of 1.29 mm. The helical incandescent body 6 has supporting rings 7.

The current is applied to the incandescent body 6 by the inside current conductor 4 made according to the present invention. This inside current conductor 4 is a tungsten wire having a diameter $d_1$ of 0.37 mm. Hence, the wire from which the inside current conductor 4 was prepared is about 1.5 times thicker than the wire of the incandescent body 6. As it is shown in FIG. 2 in this case the inside current conductor 4 obtained according to the invention consists of three clearly distinguishable parts forming one continuous conductor. The outer diameter of the spiral part 1 amounts to about 5.2 mm, i.e. $D_1 = 4 \times D_{sp} = 5.2$ mm. The outer diameter of the second spiral member 2 corresponds substantially to the outer diameter of the incandescent body 6. The length $L_1$ of the first spiral part 1 is about 32 mm, the length $L_2$ of the second spiral part 2 is substantially 6 mm and the length L of the elongated part amounts to about 19 mm.

The inside current conductor formed as a series assembly 4 described above, is electrically connected to the incandescent body 6 equipped with the supporting rings 7 and the whole assembly is mounted within the curved quartz enclosure 5. Thereafter the lamp is completed in a conventional manner.

The lamp has a gas filling including bromine as a halogen element. In addition, krypton is also present.

The heat radiating lamp was connected to an appropriate current source; during operation no deposition could be observed on the neck part of the lamp.

It will be understood that the above description of the present invention is susceptible to various modifications, changes and adaptations, and the same are intended to be comprehended within the meaning and range of equivalents of the appended claims.

We claim:

1. An assembly for a halogen-filled incandescent lamp, said assembly comprising an incandescent body made of wire and having an outer diameter and an end; energizing means for energizing said incandescent body; a current conducting an elongated part being connected to said energizing means; a first spiral member connected to the elongated part; a second spiral member connected to said first spiral member and said incandescent body; said first spiral member having an outer diameter greater than an outer diameter of said second spiral member; a greatest than an outer diameter of said second spiral member; a greatest outer diameter of said first spiral member being approximately between 2 to 9.6 times greater than said outer diameter of said incandescent body; the outer diameter of said second spiral member being at most equal to the outer diameter of said incandescent body; said elongated part, said first spiral member and said second spiral member being made of tungsten wire of circular cross section and forming a series assembly having a lower electric resistance than an electric resistance of said wire of said incandescent body; and said tungsten wire having a diameter being at least about 1.4 times greater than a diameter of said wire of said incandescent body.

2. An assembly according to claim 1 wherein said tungsten wire is thicker than said wire of said incandescent body.

3. A halogen-filled incandescent lamp, comprising a curved tube enclosure made of a translucent material and enclosing a gas filling including a halogen element and a noble gas; a spiral incandescent body made of a tungsten wire of substantially circular cross section and being disposed within said enclosure; the incandescent body having an outer diameter, and opposite first and second ends; energizing means for energizing said incandescent body; a current conducting elongated part having opposite first and second ends; the first end of the elongated part being connected to said energizing means; a first current conducting spiral member having a greatest outer diameter and opposite first and second ends; the first end of the first spiral member being connected to the second end of said elongated part; a second current conducting spiral member having opposite first and second ends; the first end of the first spiral member being connected to the second end of said elongated part; a second current conducting spiral member having opposite first and second ends; the first end of the second spiral member being connected to the second end of said first spiral member; said greatest outer diameter of said first spiral member being approximately between 2 to 9.6 time greater than said outer diameter of said incandescent body; said elongated part, said first spiral member and said second spiral member being made of a wire of circular cross section and forming a series assembly disposed in the enclosure; said wire of said elongated part and said first and second spiral members having a diameter being substantially at least 1.4 times greater than a diameter of said tungsten wire of said incandescent body; said series assembly being present in a pair; the second end of said second spiral member of one series assembly forming said pair being connected to the first end of said incandescent body and the second end of said second spiral member of the other series assembly forming said pair being connected to the second end of said incandescent body.

4. The incandescent lamp according to claim 3, wherein said second spiral member is at least partly overlapped by said incandescent body.

5. The incandescent lamp according to claim 3, wherein said first spiral member has an outer diameter exceeding an outer diameter of said second spiral member; the outer diameter of the second spiral member being at most equal to the outer diameter of said incandescent body.

6. The incandescent lamp according to claim 3, wherein said series assembly is made of tungsten wire.

* * * * *